US010301943B2

(12) United States Patent
Brittingham

(10) Patent No.: US 10,301,943 B2
(45) Date of Patent: May 28, 2019

(54) TURBOMACHINE ROTOR BLADE

(71) Applicant: General Electric Company, Schenectady, NY (US)

(72) Inventor: Robert Alan Brittingham, Greer, SC (US)

(73) Assignee: General Electric Company, Schenectady, NY (US)

( * ) Notice: Subject to any disclaimer, the term of this patent is extended or adjusted under 35 U.S.C. 154(b) by 211 days.

(21) Appl. No.: 15/638,547

(22) Filed: Jun. 30, 2017

(65) Prior Publication Data

US 2019/0003311 A1 Jan. 3, 2019

(51) Int. Cl.

| | |
|---|---|
| ***F01D 5/22*** | (2006.01) |
| ***F01D 5/14*** | (2006.01) |
| ***F01D 5/20*** | (2006.01) |
| ***F01D 5/18*** | (2006.01) |

(52) U.S. Cl.

CPC ..... *F01D 5/147* (2013.01); *F01D 5/187* (2013.01); *F01D 5/20* (2013.01); *F01D 5/225* (2013.01); *F01D 5/18* (2013.01); *F05D 2240/24* (2013.01); *F05D 2240/301* (2013.01); *F05D 2240/307* (2013.01); *F05D 2240/81* (2013.01); *F05D 2250/20* (2013.01); *F05D 2260/202* (2013.01); *F05D 2260/22141* (2013.01)

(58) Field of Classification Search

CPC .... F01D 5/225; F01D 5/187; F05D 2240/307; F05D 2240/81

See application file for complete search history.

(56) References Cited

U.S. PATENT DOCUMENTS

| | | | | |
|---|---|---|---|---|
| 3,876,330 | A | 4/1975 | Pearson et al. | |
| 4,127,358 | A | 11/1978 | Parkes | |
| 4,948,338 | A | 8/1990 | Wickerson | |
| 5,350,277 | A * | 9/1994 | Jacala | F01D 5/185 416/90 R |
| 6,099,253 | A | 8/2000 | Fukue et al. | |
| 6,135,715 | A * | 10/2000 | Correia | F01D 5/20 416/97 R |

(Continued)

FOREIGN PATENT DOCUMENTS

| | | |
|---|---|---|
| EP | 2607629 A1 | 6/2013 |
| FR | 2275975 A5 | 1/1976 |
| JP | 5868609 B2 | 2/2016 |

OTHER PUBLICATIONS

U.S. Appl. No. 14/974,155, filed Dec. 18, 2015.
U.S. Appl. No. 14/974,193, filed Dec. 18, 2015.
U.S. Appl. No. 15/615,876, filed Jun. 7, 2017.

*Primary Examiner* — Justin D Seabe
*Assistant Examiner* — Behnoush Haghighian
(74) *Attorney, Agent, or Firm* — Dority & Manning, P.A.

(57) ABSTRACT

The present disclosure is directed to a rotor blade for a turbomachine. The rotor blade includes an airfoil defining a cooling passage and a tip shroud coupled to the airfoil. The tip shroud includes first and second walls that at least partially define a cooling core fluidly coupled to the cooling passage. The rotor blade also includes a plurality of ribs positioned within the cooling core and coupled to the first and second walls. The reinforcing structure includes a plurality of interconnected ribs having a first rib with a first orientation and a second rib with a second orientation. The first and second orientations are different in three spatial dimensions.

20 Claims, 6 Drawing Sheets

(56) References Cited

U.S. PATENT DOCUMENTS

| | | | | |
|---|---|---|---|---|
| 6,152,694 | A | 11/2000 | Ai | |
| 6,152,695 | A | 11/2000 | Fukue et al. | |
| 6,811,378 | B2 | 11/2004 | Kraft | |
| 6,869,270 | B2 * | 3/2005 | Bunker | F01D 5/187 416/189 |
| 7,273,347 | B2 | 9/2007 | Rathmann | |
| 7,568,882 | B2 * | 8/2009 | Brittingham | F01D 5/187 415/1 |
| 7,686,581 | B2 * | 3/2010 | Brittingham | F01D 5/187 416/97 R |
| 7,901,180 | B2 * | 3/2011 | Abdel-Messeh | F01D 5/187 415/115 |
| 7,946,816 | B2 * | 5/2011 | Brittingham | F01D 5/225 416/189 |
| 7,946,817 | B2 * | 5/2011 | Brittingham | F01D 5/186 416/189 |
| 8,057,177 | B2 * | 11/2011 | Brittingham | F01D 5/187 416/189 |
| 8,348,612 | B2 * | 1/2013 | Brittingham | F01D 5/225 416/191 |
| 8,764,395 | B2 * | 7/2014 | Wilhelm | F01D 5/225 416/97 R |
| 8,894,368 | B2 * | 11/2014 | Jones | F01D 5/225 416/191 |
| 8,951,013 | B2 * | 2/2015 | Miller | F01D 5/16 416/190 |
| 9,127,560 | B2 * | 9/2015 | Collier | F01D 5/187 |
| 9,249,667 | B2 * | 2/2016 | Noble | F01D 5/147 |
| 9,759,070 | B2 * | 9/2017 | Zhang | F01D 5/186 |
| 10,036,258 | B2 * | 7/2018 | Mongillo | F01D 5/187 |
| 10,077,664 | B2 * | 9/2018 | Clum | F01D 5/187 |
| 10,202,852 | B2 * | 2/2019 | Jaiswal | F01D 5/186 |
| 2009/0180894 | A1 * | 7/2009 | Brittingham | F01D 5/225 416/97 R |
| 2012/0070309 | A1 | 3/2012 | Zambetti et al. | |
| 2017/0114645 | A1 | 4/2017 | Chouhan et al. | |
| 2017/0114647 | A1 | 4/2017 | Chouhan et al. | |
| 2017/0114648 | A1 | 4/2017 | Chouhan et al. | |
| 2017/0138203 | A1 | 5/2017 | Jaiswal et al. | |

* cited by examiner

TURBOMACHINE ROTOR BLADE

FIELD

The present disclosure generally relates to turbomachines. More particularly, the present disclosure relates rotor blades for turbomachines.

BACKGROUND

A gas turbine engine generally includes a compressor section, a combustion section, and a turbine section. The compressor section progressively increases the pressure of air entering the gas turbine engine and supplies this compressed air to the combustion section. The compressed air and a fuel (e.g., natural gas) mix within the combustion section and burn within one or more combustion chambers to generate high pressure and high temperature combustion gases. The combustion gases flow from the combustion section into the turbine section where they expand to produce work. For example, expansion of the combustion gases in the turbine section may rotate a rotor shaft connected to a generator to produce electricity.

The turbine section generally includes a plurality of rotor blades. Each rotor blade includes an airfoil positioned within the flow of the combustion gases. In this respect, the rotor blades extract kinetic energy and/or thermal energy from the combustion gases flowing through the turbine section. Certain rotor blades may include a tip shroud coupled to the radially outer end of the airfoil. The tip shroud reduces the amount of combustion gases leaking past the rotor blade.

The rotor blades generally operate in extremely high temperature environments. As such, the tip shroud of each rotor blade may define various cooling passages through which a coolant may flow. Nevertheless, the presence of the cooling passages may reduce the stiffness of the tip shroud, which may limit the service life of the rotor blade.

BRIEF DESCRIPTION

Aspects and advantages of the technology will be set forth in part in the following description, or may be obvious from the description, or may be learned through practice of the technology.

In one aspect, the present disclosure is directed to a rotor blade for a turbomachine. The rotor blade includes an airfoil defining a cooling passage and a tip shroud coupled to the airfoil. The tip shroud includes first and second walls that at least partially define a cooling core fluidly coupled to the cooling passage. The rotor blade also includes a reinforcing structure positioned within the cooling core and coupled to the first and second walls. The reinforcing structure includes a plurality of interconnected ribs having a first rib with a first orientation and a second rib with a second orientation. The first and second orientations are different in three spatial dimensions.

In another aspect, the present disclosure is directed to a turbomachine including a turbine section having one or more rotor blades. Each rotor blade includes an airfoil defining a cooling passage and a tip shroud coupled to the airfoil. The tip shroud includes first and second walls that at least partially define a cooling core fluidly coupled to the cooling passage. The rotor blade also includes a reinforcing structure positioned within the cooling core and coupled to the first and second walls. The reinforcing structure includes a plurality of interconnected ribs having a first rib with a first orientation and a second rib with a second orientation. The first and second orientations are different in three spatial dimensions.

These and other features, aspects and advantages of the present technology will become better understood with reference to the following description and appended claims. The accompanying drawings, which are incorporated in and constitute a part of this specification, illustrate embodiments of the technology and, together with the description, serve to explain the principles of the technology.

BRIEF DESCRIPTION OF THE DRAWINGS

A full and enabling disclosure of the present technology, including the best mode thereof, directed to one of ordinary skill in the art, is set forth in the specification, which makes reference to the appended figures, in which.

Figure 1:
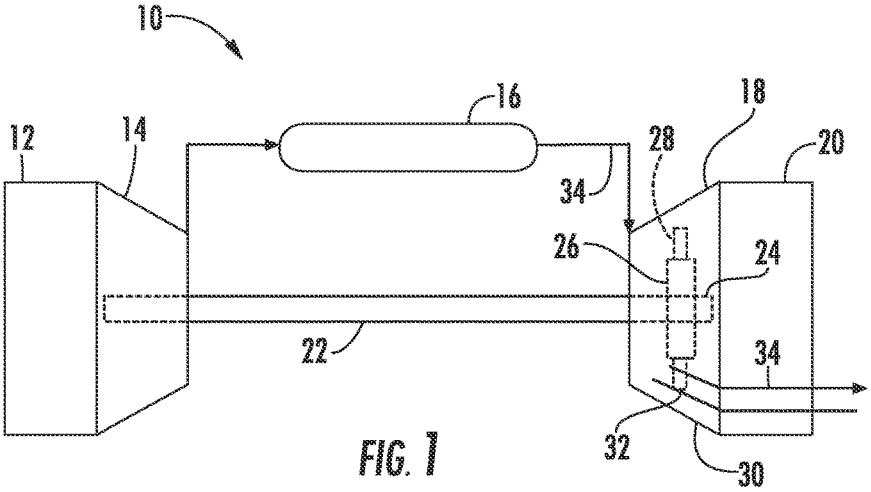
FIG. 1 is a schematic view of an exemplary gas turbine engine in accordance with the embodiments disclosed herein.

Repeat use of reference characters in the present specification and drawings is intended to represent the same or analogous features or elements of the present technology.

DETAILED DESCRIPTION

Reference will now be made in detail to present embodiments of the technology, one or more examples of which are illustrated in the accompanying drawings. The detailed description uses numerical and letter designations to refer to features in the drawings. Like or similar designations in the drawings and description have been used to refer to like or similar parts of the technology. As used herein, the terms "first", "second", and "third" may be used interchangeably to distinguish one component from another and are not intended to signify location or importance of the individual components. The terms "upstream" and "downstream" refer to the relative direction with respect to fluid flow in a fluid pathway. For example, "upstream" refers to the direction from which the fluid flows, and "downstream" refers to the direction to which the fluid flows.

Each example is provided by way of explanation of the technology, not limitation of the technology. In fact, it will be apparent to those skilled in the art that modifications and variations can be made in the present technology without departing from the scope or spirit thereof. For instance, features illustrated or described as part of one embodiment may be used on another embodiment to yield a still further embodiment. Thus, it is intended that the present technology covers such modifications and variations as come within the scope of the appended claims and their equivalents.

Although an industrial or land-based gas turbine is shown and described herein, the present technology as shown and described herein is not limited to a land-based and/or industrial gas turbine unless otherwise specified in the claims. For example, the technology as described herein may be used in any type of turbomachine including, but not limited to, aviation gas turbines (e.g., turbofans, etc.), steam turbines, and marine gas turbines.

Referring now to the drawings, wherein identical numerals indicate the same elements throughout the figures, FIG. 1 schematically illustrates a gas turbine engine 10. As shown, the gas turbine engine 10 may include an inlet section 12, a compressor section 14, a combustion section 16, a turbine section 18, and an exhaust section 20. The compressor section 14 and turbine section 18 may be coupled by a shaft 22. The shaft 22 may be a single shaft or a plurality of shaft segments coupled together to form the shaft 22.

The turbine section 18 may include a rotor shaft 24 having a plurality of rotor disks 26 (one of which is shown) and a plurality of rotor blades 28. Each rotor blade 28 extends radially outward from and interconnects to one of the rotor disks 26. Each rotor disk 26, in turn, may be coupled to a portion of the rotor shaft 24 that extends through the turbine section 18. The turbine section 18 further includes an outer casing 30 that circumferentially surrounds the rotor shaft 24 and the rotor blades 28, thereby at least partially defining a hot gas path 32 through the turbine section 18.

During operation, the gas turbine engine 10 produces mechanical rotational energy, which may, e.g., be used to generate electricity. More specifically, air enters the inlet section 12 of the gas turbine engine 10. From the inlet section 12, the air flows into the compressor 14, where it is progressively compressed to provide compressed air to the combustion section 16. The compressed air in the combustion section 16 mixes with a fuel to form an air-fuel mixture, which combusts to produce high temperature and high pressure combustion gases 34. The combustion gases 34 then flow through the turbine 18, which extracts kinetic and/or thermal energy from the combustion gases 34. This energy extraction rotates the rotor shaft 24, thereby creating mechanical rotational energy for powering the compressor section 14 and/or generating electricity. The combustion gases 34 exit the gas turbine engine 10 through the exhaust section 20.

Figure 2:
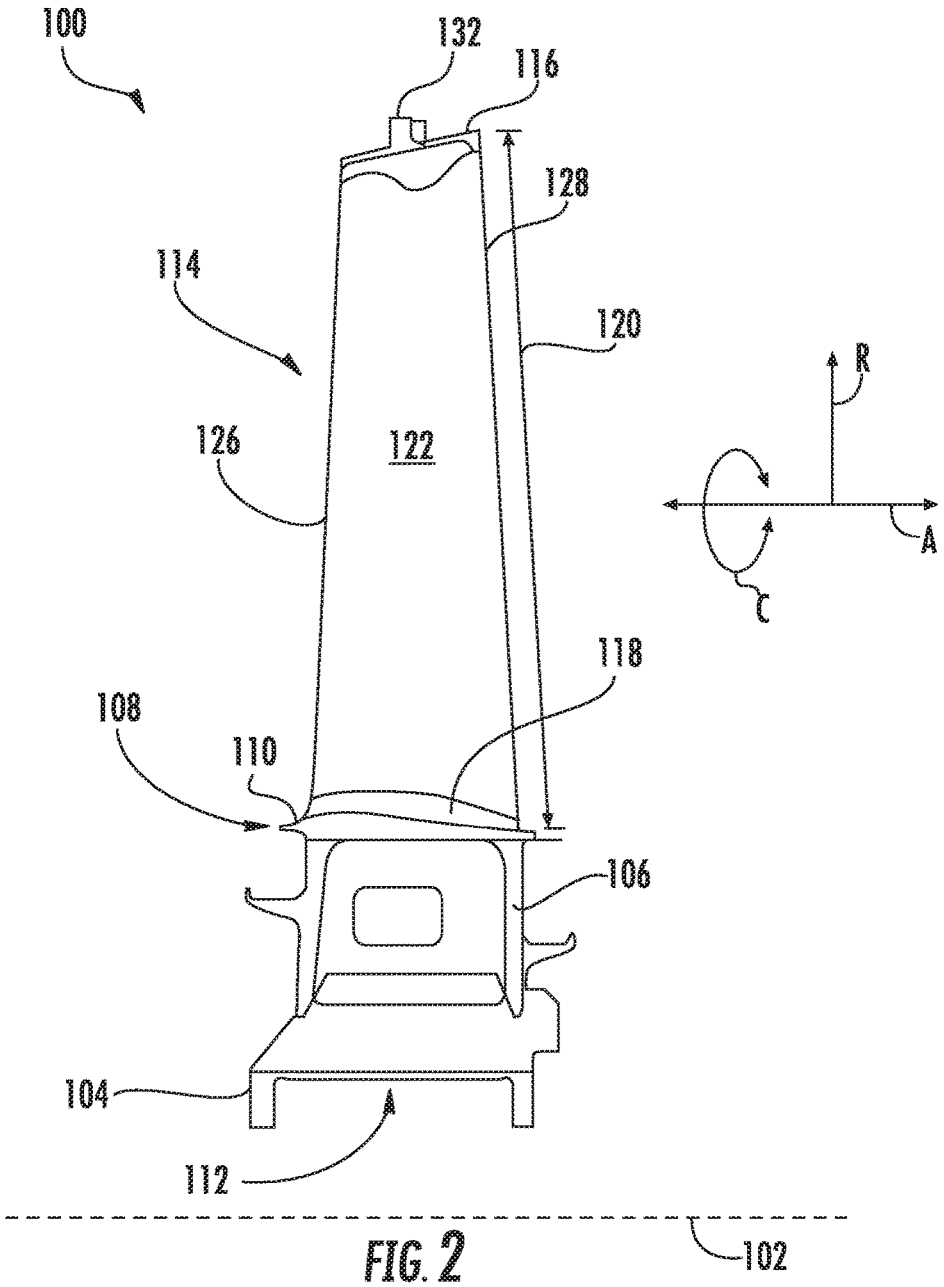
FIG. 2 is a side view of an exemplary rotor blade in accordance with the embodiments disclosed herein.

FIG. 2 is a side view of an exemplary rotor blade 100, which may be incorporated into the turbine section 18 of the gas turbine engine 10 in place of the rotor blade 28. As shown, the rotor blade 100 defines an axial direction A, a radial direction R, and a circumferential direction C. In general, the axial direction A extends parallel to an axial centerline 102 of the shaft 24 (FIG. 1), the radial direction R extends generally orthogonal to the axial centerline 102, and the circumferential direction C extends generally concentrically around the axial centerline 102. The rotor blade 100 may also be incorporated into the compressor section 14 of the gas turbine engine 10 (FIG. 1).

As illustrated in FIG. 2, the rotor blade 100 may include a dovetail 104, a shank portion 106, and a platform 108. More specifically, the dovetail 104 secures the rotor blade 100 to the rotor disk 26 (FIG. 1). The shank portion 106 couples to and extends radially outward from the dovetail 104. The platform 108 couples to and extends radially outward from the shank portion 106. The platform 108 includes a radially outer surface 110, which generally serves as a radially inward flow boundary for the combustion gases 34 flowing through the hot gas path 32 of the turbine section 18 (FIG. 1). The dovetail 104, the shank portion 106, and the platform 108 may define an intake port 112, which permits a coolant (e.g., bleed air from the compressor section 14) to enter the rotor blade 100. In the embodiment shown in FIG. 2, the dovetail 104 is an axial entry fir tree-type dovetail. Alternately, the dovetail 104 may be any suitable type of dovetail. In fact, the dovetail 104, shank portion 106, and/or platform 108 may have any suitable configurations.

Figure 3:
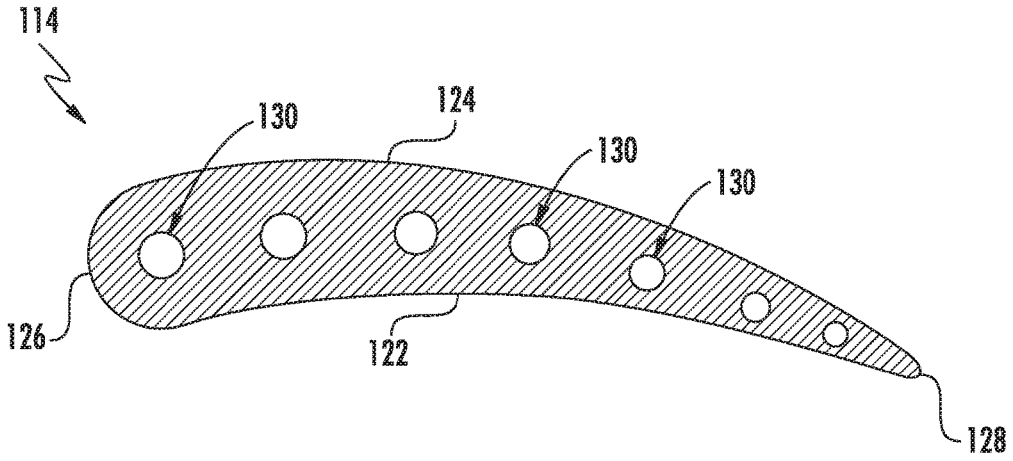
FIG. 3 is cross-sectional view of an exemplary airfoil in accordance with the embodiments disclosed herein.

Referring now to FIGS. 2 and 3, the rotor blade 100 further includes an airfoil 114. In particular, the airfoil 114 extends radially outward from the radially outer surface 110 of the platform 108 to a tip shroud 116. The airfoil 114 couples to the platform 108 at a root 118 (i.e., the intersection between the airfoil 114 and the platform 116). In this respect, the airfoil 118 defines an airfoil span 120 extending between the root 118 and the tip shroud 116. The airfoil 114 also includes a pressure side surface 122 and an opposing suction side surface 124 (FIG. 3). The pressure side surface 122 and the suction side surface 124 are joined together or interconnected at a leading edge 126 of the airfoil 114 and a trailing edge 128 of the airfoil 114. As shown, the leading edge 126 is oriented into the flow of combustion gases 34 (FIG. 1), while the trailing edge 128 is spaced apart from and positioned downstream of the leading edge 126. The pressure side surface 122 and the suction side surface 124 are continuous about the leading edge 126 and the trailing edge 128. Furthermore, the pressure side surface 122 is generally concave, and the suction side surface 124 is generally convex.

As shown in FIG. 3, the airfoil 114 may define one or more cooling passages 130 extending therethrough. More specifically, the cooling passages 130 may extend from the tip shroud 116 radially inward to the intake port 112. In this respect, coolant may flow through the cooling passages 130 from the intake port 112 to the tip shroud 116. In the embodiment shown in FIG. 3, for example, the airfoil 114 defines seven cooling passages 130. In alternate embodiments, however, the airfoil 114 may define more or fewer cooling passages 130.

Figure 4:
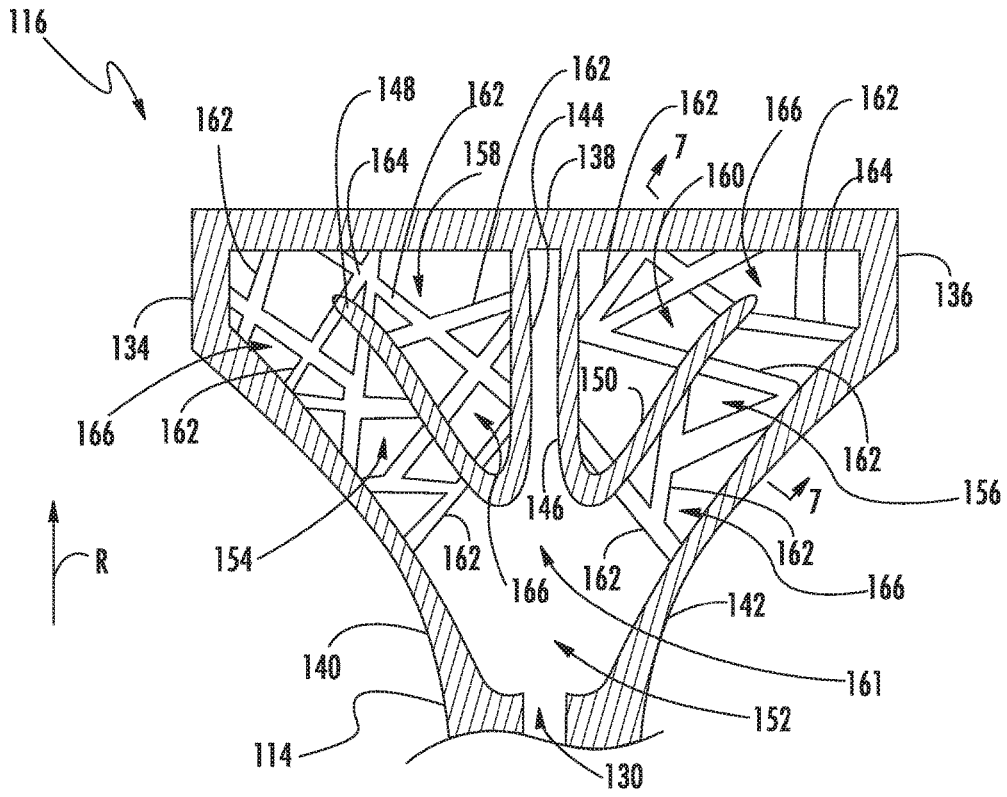
FIG. 4 is a cross-sectional view of one embodiment of a tip shroud, illustrating a plurality of non-uniformly arranged ribs of a reinforcing structure in accordance with the embodiments disclosed herein.

As mentioned above, the rotor blade 100 includes the tip shroud 116. As illustrated in FIGS. 2 and 4, the tip shroud 116 couples to the radially outer end of the airfoil 114 and generally defines the radially outermost portion of the rotor blade 100. In this respect, the tip shroud 116 reduces the amount of the combustion gases 34 (FIG. 1) that escape past the rotor blade 100. As shown in FIG. 2, the tip shroud 116 may include a seal rail 132. Alternate embodiments, however, may include more seal rails 132 (e.g., two seal rails 132, three seal rails 132, etc.) or no seal rails 132.

Referring now to FIG. 4, the tip shroud 116 includes various walls. More specifically, the tip shroud 116 may include first and second opposing side walls 134, 136 and a radially outer wall 138 extending between the first and second side walls 134, 136. The tip shroud 116 may also include first and second fillet walls 140, 142 that respectively extend from the first and second side walls 134, 136 to the airfoil 114. As shown, the first and second side walls 134, 136, the radially outer wall 138, and the first and second fillet walls 140, 142 generally define the exterior of the tip shroud 116. Furthermore, the tip shroud 116 may include various interior walls. In the embodiment shown, for example, the tip shroud 116 may include first and second radially-extending walls 144, 146 extending radially inward from the radially outer wall 138 toward the airfoil 114. The tip shroud 116 may also include first and second arcuate walls 148, 150 coupled to the radially inner ends of the first and second radially-extending walls 144, 146. In some embodiments, the walls 144, 146 need not be curved. In alternate embodiments, however, the tip shroud 116 may have any suitable configuration of interior and exterior walls.

As shown, the tip shroud 116 defines various chambers, passages, and cavities therein. More specifically, the first and second fillet walls 140, 142, the first and second radially-extending walls 144, 146, and the airfoil 114 define a central plenum 152 in fluid communication with the cooling passage(s) 130 defined by the airfoil 114. The first fillet wall 140 and the first arcuate wall 148 define a first passage 154 therebetween. Similarly, the second fillet wall 142 and the second arcuate wall 150 define a second passage 156 therebetween. The first and second passages 154, 156 are in fluid communication with the central plenum 152. Furthermore, the radially outer wall 138, the first radially-extending wall 144, and the first arcuate wall 148 define a first chamber 158 in fluid communication with the first passage 154. Similarly, the radially outer wall 138, the second radially-extending wall 146, and the second arcuate wall 150 define a second chamber 160 in fluid communication with the second passage 156. The central plenum 152, the first and second passages 154, 156, and the first and second chambers 158, 160 are collectively referred to as a cooling core 161. In alternate embodiments, however, the tip shroud 116 may define any suitable configuration of chambers, passages, and cavities.

The rotor blade 100 further includes a reinforcing structure 164 positioned within the cooling core 161 defined by the tip shroud 116. As will be discussed in greater detail below, the reinforcing structure 164 increases the stiffness of the tip shroud 116 without significantly increasing the weight of the tip shroud 116. In the embodiment shown in FIG. 4, the reinforcing structure 164 is positioned within the first and second passages 154, 156 and the first and second cavities 158, 160 of the cooling core 161. In alternate embodiments, however, the reinforcing structure 164 may be positioned in any or all of the chambers, passages, and cavities of the cooling core 161.

As illustrated in FIG. 4, the reinforcing structure 164 includes a plurality of ribs 162. In some embodiments, the ribs 162 may be interconnected. Each of the ribs 162 extend between two walls of the tip shroud 116, between one wall of tip shroud 116 and another rib 162, or between two other ribs 162. For example, each rib 162 within the first passage 154 may extend between any pair of the first side wall 134, the radially outer wall 138, the first fillet wall 140, the first arcuate wall 148, and other ribs 162. Similarly, each rib 162 within the second passage 156 may extend between any pair of the second side wall 136, the radially outer wall 138, the second fillet wall 142, the second arcuate wall 150, and other ribs 162. Furthermore, the ribs 162 within the first chamber 158 may extend between any pair of the first side wall 134, the radially outer wall 138, the first radially-extending wall 144, the first arcuate wall 148, and other ribs 162. Similarly, the ribs 162 within the second chamber 160 may extend between any pair of the second side wall 136, the radially outer wall 138, the second radially-extending wall 146, the second arcuate wall 150, and other ribs 162. As shown, any of the ribs 162 may extend between a pair of other ribs 162. Nevertheless, the ribs 162 may extend between any combination of walls of the tip shroud 162 and other ribs 162.

In particular embodiments, some of the ribs 162 may have different orientations than other ribs 162. For example, the orientation of at least some of the ribs 162 may be different in three spatial dimensions (e.g., the axial, radial, and circumferential directions A, R, C) than other ribs 162. Nevertheless, the ribs 162 may have any suitable orientation so long as at least one of the ribs 162 has a different orientation than another of the ribs 162.

In the embodiment shown in FIG. 4, the plurality of ribs 162 are arranged in a non-uniform arrangement. In particular, the ribs 162 may be arranged in a random manner in which there is no regular repeated unit or arrangement of ribs 162. In such embodiments, one group of ribs 162 has a different arrangement than another group of ribs 162. In one embodiment, for example, the arrangement of the ribs 162 may imitate the internal structure of a bird bone. Furthermore, the non-uniform arrangements of ribs 162 within the different chambers, passages, and cavities of the cooling core 161 may be different. For example, as shown in FIG. 4, the non-uniform arrangement of the ribs 162 within the first and second chambers 158, 160 are different. Moreover, the first and second chambers 158, 160 include different numbers of ribs 162. Alternatively, the various chambers, passages, and cavities of the cooling core 161 may each have the same number and/or non-uniform arrangement of ribs 162.

Figure 5:
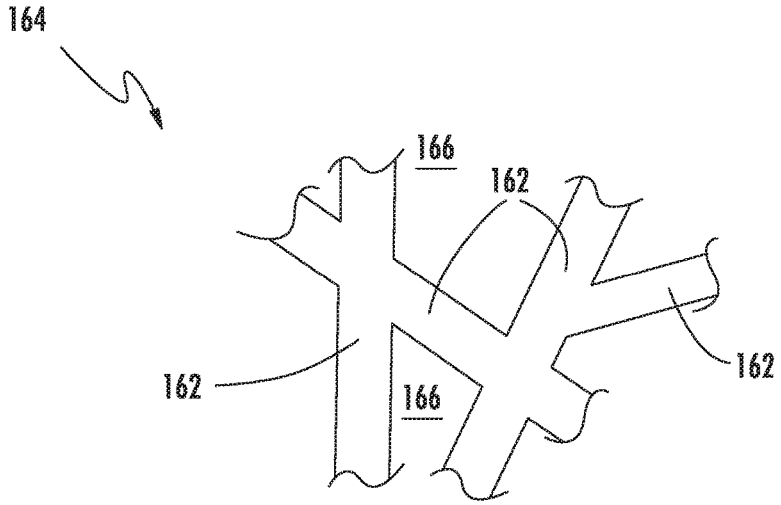
FIG. 5 is an enlarged side view of a portion of a reinforcing structure, illustrating a plurality of ribs intersecting with each other in accordance with the embodiments disclosed herein.

FIG. 5 illustrates a group of four non-uniformly arranged ribs 162 of the reinforcing structure 164. As shown, the ribs 162 may intersect each other in any suitable manner. For example, the ribs 162 may intersect each other at acute and/or obtuse angles. Furthermore, fillets (not shown) may transition between intersecting ribs 162. The fillets may have any suitable size and/or shape.

As shown in FIGS. 4 and 5, the reinforcing structure 164 defines a plurality of spaces 166 between the ribs 162. The spaces 166 permit coolant to flow through the reinforcing structure 164 in the cooling core 161.

Figure 6:
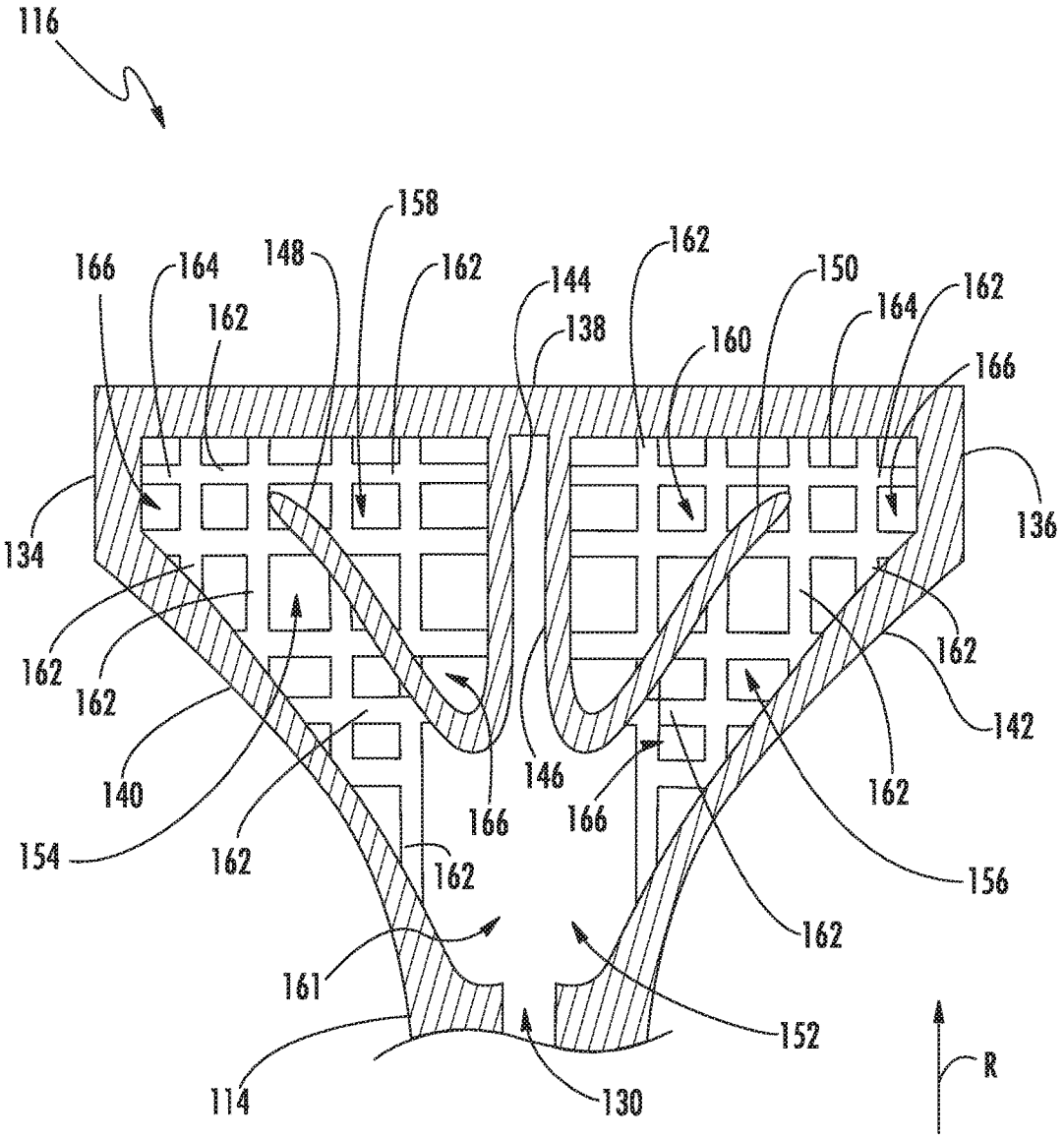
FIG. 6 is a cross-sectional view of another embodiment of a tip shroud, illustrating a plurality of uniformly arranged ribs of a reinforcing structure in accordance with the embodiments disclosed herein.

FIG. 6 illustrates an alternate embodiment of the tip shroud 116. As shown, the plurality of ribs 162 is arranged in a uniform arrangement. In this respect, the ribs 162 may be arranged such that there is a regular repeated unit or arrangement of ribs 162. In such embodiments, one group of ribs 162 has same arrangement as another group of ribs 162. In the embodiment shown in FIG. 6, for example, the ribs 162 may be arranged to form a lattice structure. Furthermore, the uniform arrangements of ribs 162 within the different chambers, passages, and cavities of the cooling core 161 may be same. For example, as shown in FIG. 6, the uniform arrangements of the ribs 162 within the first and second chambers 158, 160 are the same. Moreover, the first and second chambers 158, 160 include the same number of ribs 162. Alternatively, the various chambers, passages, and cavities of the cooling core 161 may each have a different number and/or uniform arrangement of ribs 162.

Figure 7:
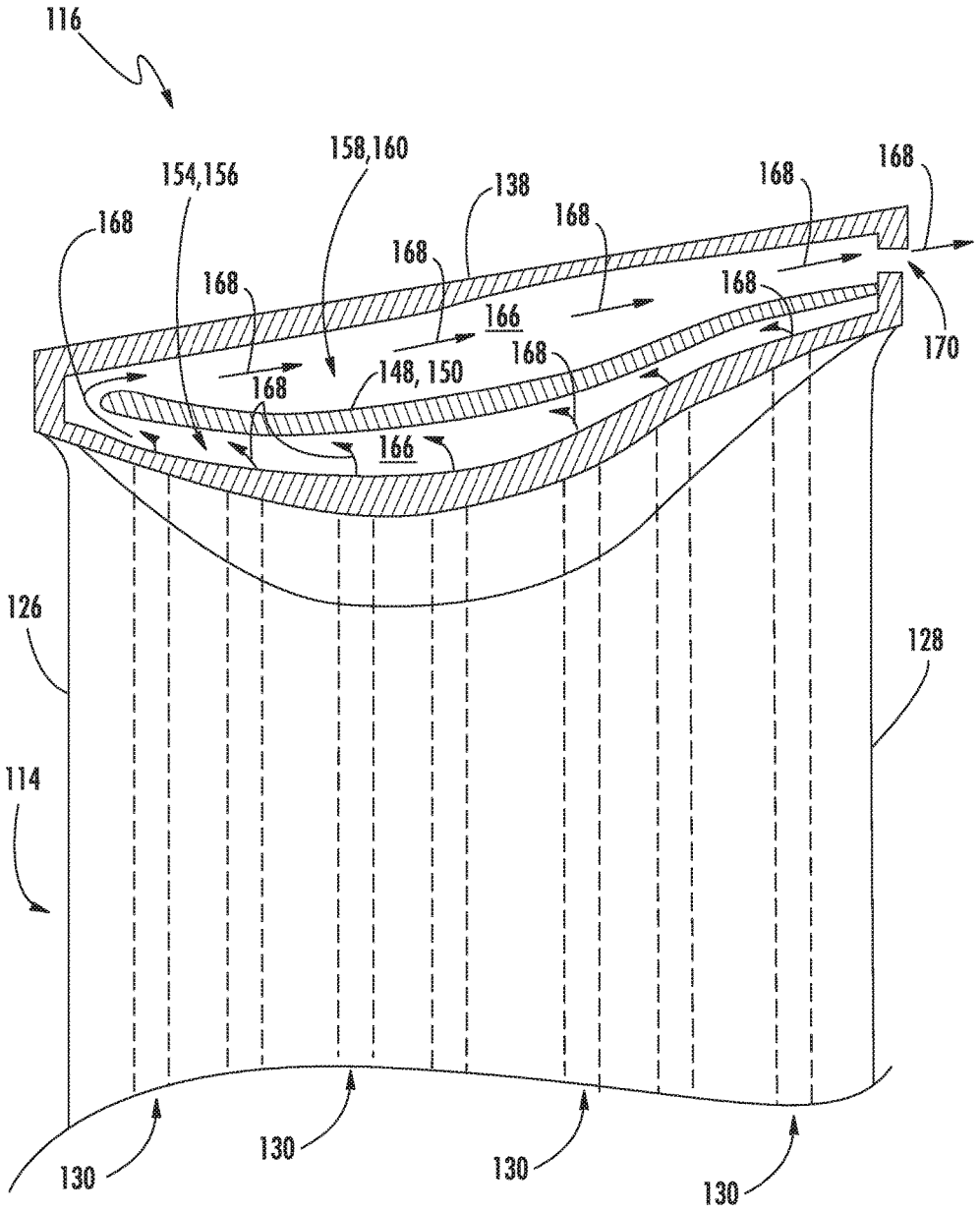
FIG. 7 is a cross-section of the tip shroud taken generally about line 7-7 in FIG. 4, illustrating a flow of coolant through the tip shroud in accordance with the embodiments disclosed herein.

During operation of the gas turbine engine 10, coolant flows through the cooling core 161 to cool the tip shroud 116. More specifically, as shown in FIG. 7, a coolant 168 (e.g., bleed air from the compressor section 14) enters the rotor blade 100 through the intake port 112 (FIG. 2). At least a portion of the coolant 168 flows through the cooling passages 130 in the airfoil 114 and into the central plenum 152 (FIG. 4) in the tip shroud 116. From the central plenum 152, the coolant 168 flows through the first and second passages 154, 156 and into the first and second cavities 158, 160. The spaces 166 defined between the ribs 162 of the reinforcing structure 164 permit the coolant 168 to flow through the in the cooling core 161, thereby convectively cooling the various walls of the tip shroud 116. The coolant 168 may then exit the tip shroud 116 through an outlet aperture 170, which may be defined along the trailing edge 128, and flow into the hot gas path 32 (FIG. 1).

As described in greater detail above, the rotor blade 100 includes a reinforcing structure 164 having a plurality of ribs 162 positioned within one or more of the various chambers, passages, and cavities of the cooling core 161 defined the tip shroud 116. The ribs 162 increase the stiffness of the tip shroud 116 without significantly increasing the weight of the rotor blade 100. In particular, the ribs 162 extend between various walls of the tip shroud 116 to reduce the relative movement therebetween. Furthermore, the use of the ribs 162 in the tip shroud 116 requires less material than forming a solid or mostly solid tip shroud. In this respect, the rotor blade 100 may be stiffer than conventional rotor blades having tip shrouds that define cooling passages, thereby resulting in a longer service life.

This written description uses examples to disclose the technology, including the best mode, and also to enable any person skilled in the art to practice the technology, including making and using any devices or systems and performing any incorporated methods. The patentable scope of the technology is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A rotor blade for a turbomachine, rotor blade comprising:

an airfoil defining a cooling passage;

a tip shroud coupled to the airfoil, the tip shroud including first and second walls that at least partially define a cooling core fluidly coupled to the cooling passage; and a reinforcing structure positioned within the cooling core and coupled to the first and second walls, the reinforcing structure comprising a plurality of interconnected ribs including a first rib having a first orientation and a second rib having a second orientation, the first and second orientations being different in three spatial dimensions.

2. The rotor blade of claim 1, wherein one of the plurality of ribs extends from the first wall to the second wall.

3. The rotor blade of claim 1, wherein the plurality of ribs are non-uniformly arranged within the cooling core.

4. The rotor blade of claim 1, wherein a pair of the plurality of ribs intersect.

5. The rotor blade of claim 1, wherein the plurality of ribs are uniformly arranged within the cooling core.

6. The rotor blade of claim 5, wherein the plurality of ribs are arranged to form a lattice structure within the cooling core.

7. The rotor blade of claim 1, wherein the reinforcing structure defines a plurality of spaces between the plurality of ribs through which a coolant flows.

8. The rotor blade of claim 1, wherein the cooling core comprises a first cooling cavity and a second cooling cavity and the reinforcing structure comprises a first portion of the reinforcing structure positioned within the first cooling cavity and second portion of the reinforcing structure positioned within the second cooling cavity, the first portion of the reinforcing structure comprising a different number of ribs than the second portion of the reinforcing structure.

9. The rotor blade of claim 1, wherein the cooling core comprises a first cooling cavity and a second cooling cavity and the reinforcing structure comprises a first portion of the reinforcing structure positioned within the first cooling cavity and second portion of the reinforcing structure positioned within the second cooling cavity, the first portion of the reinforcing structure having a different arrangement than the second portion of the reinforcing structure.

10. The rotor blade of claim 1, wherein the cooling core comprises a first cooling cavity and a second cooling cavity and the reinforcing structure comprises a first portion of the reinforcing structure positioned within the first cooling cavity and second portion of the reinforcing structure positioned within the second cooling cavity, the first portion of the reinforcing structure having a same arrangement than the second portion of the reinforcing structure.

11. A turbomachine, comprising:

a turbine section including one or more rotor blades, each rotor blade comprising:

an airfoil defining a cooling passage;

a tip shroud coupled to the airfoil, the tip shroud including first and second walls that at least partially define a cooling core fluidly coupled to the cooling passage; and a reinforcing structure positioned within the cooling core and coupled to the first and second walls, the reinforcing structure comprising a plurality of interconnected ribs including a first rib having a first orientation and a second rib having a second orientation, the first and second orientations being different in three spatial dimensions.

12. The turbomachine of claim 11, wherein one of the plurality of ribs extends from the first wall to the second wall.

13. The turbomachine of claim 11, wherein the plurality of ribs are non-uniformly arranged within the cooling core.

14. The turbomachine of claim 11, wherein a pair of the plurality of ribs intersect.

15. The turbomachine of claim 11, wherein the plurality of ribs are uniformly arranged within the cooling core.

16. The turbomachine of claim 15, wherein the plurality of ribs are arranged to form a lattice structure within the cooling core.

17. The turbomachine of claim 11, wherein the reinforcing structure defines a plurality of spaces between the plurality of ribs through which a coolant flows.

18. The turbomachine of claim 11, wherein the cooling core comprises a first cooling cavity and a second cooling cavity and the reinforcing structure comprises a first portion of the reinforcing structure positioned within the first cooling cavity and second portion of the reinforcing structure positioned within the second cooling cavity, the first portion of the reinforcing structure comprising a different number of ribs than the second portion of the reinforcing structure.

19. The turbomachine of claim 11, wherein the cooling core comprises a first cooling cavity and a second cooling cavity and the reinforcing structure comprises a first portion of the reinforcing structure positioned within the first cooling cavity and second portion of the reinforcing structure positioned within the second cooling cavity, the first portion of the reinforcing structure having a different arrangement than the second portion of the reinforcing structure.

20. The turbomachine of claim 11, wherein the cooling core comprises a first cooling cavity and a second cooling cavity and the reinforcing structure comprises a first portion of the reinforcing structure positioned within the first cooling cavity and second portion of the reinforcing structure positioned within the second cooling cavity, the first portion of the reinforcing structure having a same arrangement than the second portion of the reinforcing structure.

* * * * *